United States Patent [19]

Free et al.

[11] Patent Number: 4,602,842

[45] Date of Patent: Jul. 29, 1986

[54] ELECTRICAL CONNECTOR RECEPTACLE

[75] Inventors: Theodore Q. Free, Elk River; Steven K. Otto, Eden Prairie, both of Minn.

[73] Assignee: CTS Corporation, Elkhart, Ind.

[21] Appl. No.: 677,587

[22] Filed: Dec. 3, 1984

[51] Int. Cl.[4] ..... H01R 9/09

[52] U.S. Cl. ..... 339/156 R; 339/176 MP

[58] Field of Search ..... 339/17 R, 17 L, 17 LC, 339/17 C, 17 LM, 154–156, 204, 205, 176 M, 176 MP

[56] References Cited

U.S. PATENT DOCUMENTS

| | | | |
|---|---|---|---|
| 3,137,537 | 6/1964 | Cole et al. | 339/176 MP |
| 3,205,471 | 9/1965 | Herrmann | 339/17 LM |
| 3,482,201 | 12/1969 | Schneck | 339/176 MP |
| 3,639,888 | 2/1972 | Pittman et al. | 339/176 MP |
| 3,850,497 | 11/1974 | Krumreich et al. | 339/126 R |
| 3,954,320 | 5/1976 | Hardesty et al. | 339/99 R |
| 4,106,841 | 8/1978 | Vladic | 339/176 M |
| 4,221,458 | 9/1980 | Hughes et al. | 339/126 R |
| 4,460,234 | 7/1984 | Bogese | 339/222 |
| 4,497,526 | 2/1985 | Myers | 339/17 LC |

*Primary Examiner*—Neil Abrams

*Attorney, Agent, or Firm*—Rodger H. Flagg

[57] ABSTRACT

An electrical connector receptacle assembly for mounting to a support member which slidably receives a phone type jack and a portion of a printed circuit board to provide electrical communication therebetween. The connector receptacle assembly has an insert member with a plurality of slots therein. Formed contacts are positioned in the slots in the insert member to contact conductor paths on the printed circuit board and contacts in the phone type jack. Opposing contacts provide for contact with conductor paths on opposing sides of the printed circuit board. Opposing contacts may be adapted to provide electrical contact upon removal of the portion of the printed circuit board from the connector receptacle, to provide a switching function therebetween.

13 Claims, 8 Drawing Figures

10
12
14
16
18
20
22
24
25
26
27
28
29
30
31
32
33
36
38
40
42
44
46
48
50
52
54
56
82
96
114
120
122
124
125
126
127
142
2
2
110
112

ELECTRICAL CONNECTOR RECEPTACLE

TECHNICAL FIELD

An electrical connector receptacle of a type intended to slidably receive a phone-type jack and a portion of a printed circuit board therein, wherein a plurality of electrical contacts are positioned to provide electrical continuity between conductive paths on the printed circuit board and the phone-type jack.

BACKGROUND ART

U.S. Pat. No. 3,850,497 describes a connector receptacle intended for use with a phone-type jack. This receptacle uses wires for contact springs, which are connected by means of crimped electrical connections between the printed circuit board and the contact springs. The phone-type connector plug intended for use with connector receptacles of the type described above is disclosed in U.S. Pat. No. 3,954,320.

Such connector receptacles and phone-type plugs have been widely adopted in the telephone industry, and are currently being used on other electrical equipment, such as data processing equipment, modems, computers and the like. Such use in related equipment often requires the connector receptacle to be mounted in communication with a printed circuit board. The connector receptacle referenced above requires individually crimped electrical connectors, with mating ends extending from wires soldered or otherwise joined to the conductors on a printed circuit board.

An attempt to solve this problem can be found in U.S. Pat. No. 4,221,458, which is capable of being mated with phone-type plugs, such as shown in U.S. Pat. No. 3,954,320. This connector receptacle is mounted directly to the printed circuit board, by soldering the contacts directly to conductors on the printed circuit board.

This means of securement does not provide for panel mounting of the connector receptacle. Access is difficult when a cover is installed over the printed circuit board, and further requires unsoldering the conductor connections or replacing both the printed circuit board and the connector receptacle should either fail, which adds expense and complicates field repair.

DISCLOSURE OF THE INVENTION

The present invention provides for mounting the connector receptacle to a panel or other supporting device, wherein the phone-type jack and the printed circuit board may be readily inserted or removed from the receptacle as desired, without the use of tools, such as soldering guns, or the like.

The configuration of the connectors within the disclosed electrical connector may be adapted to align with conductive paths on both the top and bottom of the printed circuit board.

Further, the preferred invention herein disclosed provides contact between at least one pair of opposing contacts when the printed circuit board is removed, thereby eliminating the need for a separate switch to signal remote equipment when the system is not operational.

Therefore, one object of this invention is to provide an improved electrical connector receptacle.

Another object is to provide an improved electrical connector receptacle for mounting to a support member, wherein a phone-type jack and a portion of a printed circuit board may be releasably engaged within the connector receptacle to provide electrical communication between a plurality of conductor paths on the printed circuit board and contacts on the phone-type jack.

Another object is to provide an improved electrical connector receptacle having opposing pairs of spaced electrical contacts, to provide electrical communication between conductors on opposing sides of a printed circuit board and contacts located on the phone-type jack.

Yet another object is to provide electrical contact between at least one pair of opposed electrical contacts mounted in an electrical connector receptacle, when the printed circuit board is removed from the connector receptacle.

The above mentioned and other features and objects of this invention and the manner of attaining them will become more apparent and the invention itself will be best understood by reference to the following description of an embodiment of the invention, when considered in conjunction with the accompanying drawings.

BEST MODE FOR CARRYING OUT THE INVENTION

Figures 1, 7:
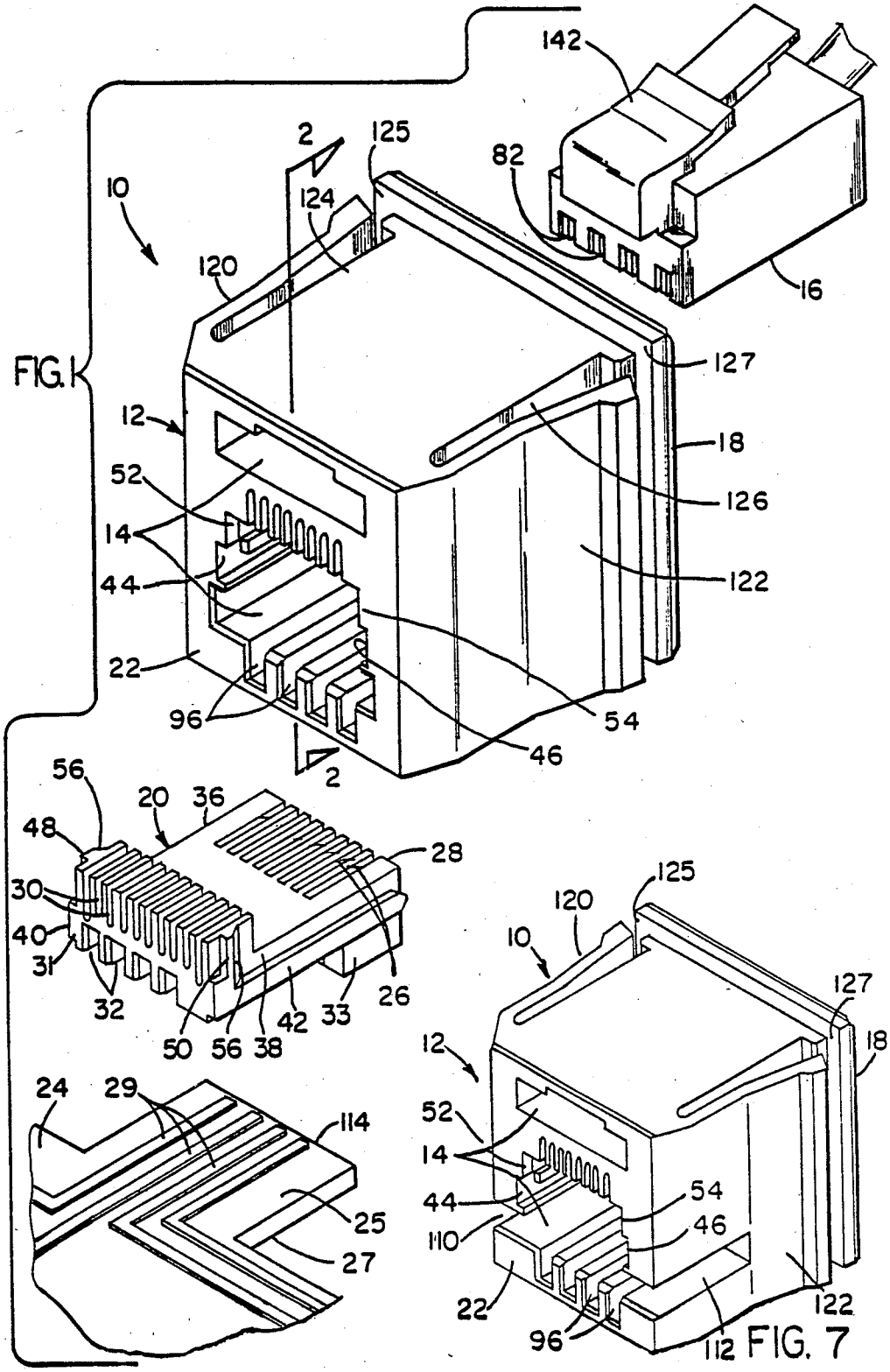
FIG. 1 is an isometric exploded view of the electrical connector receptacle showing a portion of the printed circuit board, the insert member, and the phone-type plug positioned for insertion.
FIG. 7 is an alternate isometric view of the electrical connector with side slots therein, adapted to receive a printed circuit board.

The subject matter which I regard as my invention is particularly pointed out and distinctly claimed in the claims. The structure and operation of my invention, together with further objects and advantages, may be better understood from the following description given in connection with the accompanying drawings, in which:

As shown in FIG. 1, the electrical connector receptacle 10 comprises an insulated housing 12 having an aperture 14 therethrough. The aperture 14 is molded to closely receive a phone-type connector jack 16 into end 18. Aperture 14 preferably extends through connector receptacle 10, and is formed to receive and secure an insulated insert member 20 from end 22. Aperture 14 extends beneath insert member 20 and is formed to receive a portion of a printed circuit board 24 therein.

Insert member 20 has a plurality of narrow slots 26 on insert end 28, and a plurality of complimentary narrow slots 30 on opposite end 31. A plurality of wide slots 32 are molded in insert member 20 and extend from end 31 towards slot extensions 33. Located on opposing sides 36, 38 of insert member 20 are guide means 40, 42 sized to be closely received in complementary guide means 44, 46 in housing aperture 14. Retaining means 48, 50 are preferably positioned on insert member 20 sides 36, 38 to engage and secure complimentary retaining means 52, 54 in housing aperture 14, when insert member 20 is fully inserted and positioned within housing aperture 14. An inclined edge 56 on tabs 48, 50 aids insertion of insert member 20 into housing aperture 14. Slots 26, 30 and 32 in insert member 20 are sized to closely receive and retain a plurality of electrical contacts 58, 60, shown in FIGS. 4A and 4B.

Figure 6:
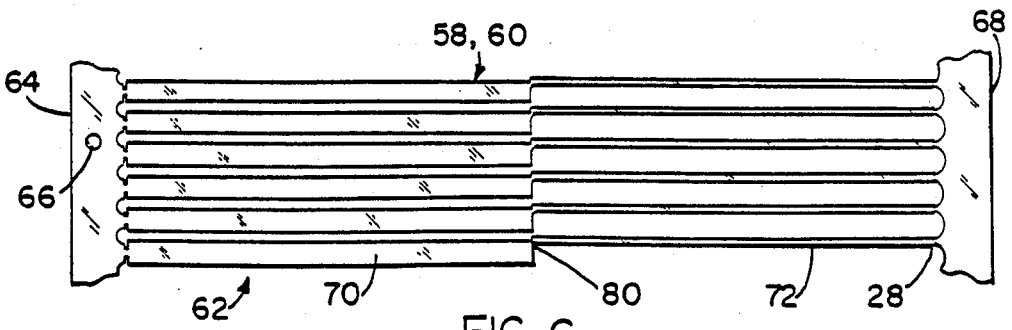
FIG. 6 shows an electrical contact strip, prior to removal or forming of individual contacts.

As shown in FIG. 6, a plurality of electrical contacts 58, 60 are preferably stamped to form reels 62, prior to forming individual contacts for ease of automation. Reel 62, preferably has a continuous support edge 64 having apertures 66 spaced therein to aid in positioning and advancing reel 62. An opposite supporting edge 68 may also be employed to support contacts 58, 60 in preparation for forming.

Figure 4A:
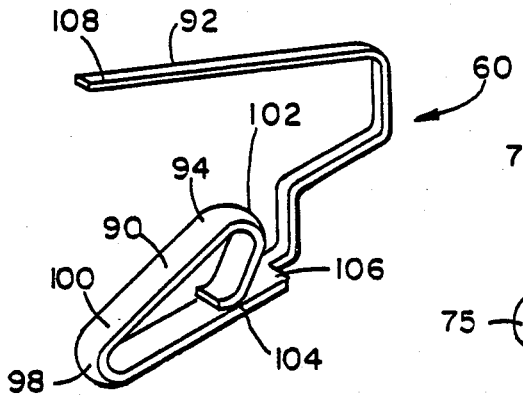
FIG. 4A is a perspective view of the lower formed contact.
Figure 4B:
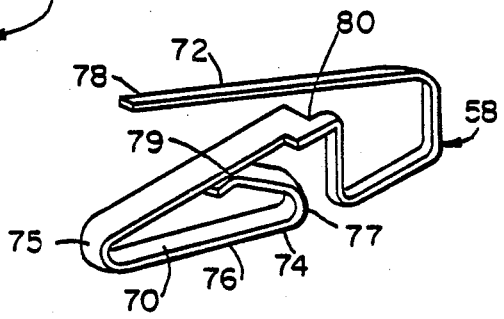
FIG. 4B is a perspective view of the upper formed contact.

As shown in FIG. 4B, the upper electrical contact 58 is formed to provide active contact regions 70, 72 at opposing ends of contact 58. A wide contact area 74 is provided for contact with a conductor path 29 located on the upper surface 25 printed circuit board 24, and is sized to be received in slots 32 of insert member 20, shown in FIG. 1. Electrical contact 58 is formed to extend from near end 22 of lower aperture 14 in connector receptacle 12 and is bent back at 75 to form an inclined contact area 76 extending towards the center of the housing 12, whereupon the remaining end portion of contact 58 is bent back at 77 as shown in FIG. 4B to bias against a portion of contact 58 at location 79 in a manner to provide positive spring engagement between the active contact region 70 of electrical contact 58 and the upper portion 25 of the printed circuit board 24 when inserted into the lower aperture 14 in the housing 12.

The narrow contact portion 72 of contact 58 is offset at 80 to align the narrow contact area 72 in spaced relation within narrow slots 26, 30 in insert 20. Narrow contact portion 72 is formed to provide an inclinded surface to provide electrical contact with contacts 82 located in phone-type connector jack 16, as jack is fully inserted into aperture 14 from connector receptacle end 18.

As shown in FIG. 4A, the lower electrical contact 60 is formed to provide active contact regions 90, 92 at opposing ends of contact 60. A wide contact area 94 is provided for contact with a conductor path 29 located on the lower surface 27 of printed circuit board 24, and is sized to be received in wide slots 96 in lower housing aperture 14. Electrical contact 60 is formed to extend from near end 22 of lower housing aperture 14, and bent back at 98 to form an inclined contact area 100 extending towards the center of housing 12, whereupon the remaining end portion of contact 60 is bent back at 102 as shown in FIG. 4B to bias against a portion of contact 60 at location 104 in a manner to provide positive spring engagement between the active contact region 90 of electrical contact 60 and a conductor path 29 located on the lower portion 27 of printed circuit board 24, when the printed circuit board is inserted into the lower aperture 14 in housing 12.

The narrow contact portion 92 of contact 60 is offset 106 to align the narrow contact area 92 in spaced relation within narrow slots 26, 30. Narrow contact portion 92 is formed to provide an inclined end 108 adapted to provide electrical contact with contacts 82 located in phone-type connector jack 16, as jack 16 is fully inserted into aperture 14 from connector receptacle housing end 18.

Active contact ends 70, 72 of contact 58, and active contact ends 90, 92 of contact 60 may be selectively plated with an improved electrical conducting material, such as gold plating, to enhance electrical conductivity. Selective plating provides a cost savings over plating the entire contact 58, 60, while providing satisfactory results.

As shown in FIG. 7, housing 12 may alternately be adapted with side slots 110, 112 to enable printed circuit board 24 to be inserted into lower aperture 14, without requiring printed circuit board extending tab 114 as shown in FIG. 1.

Figure 3:
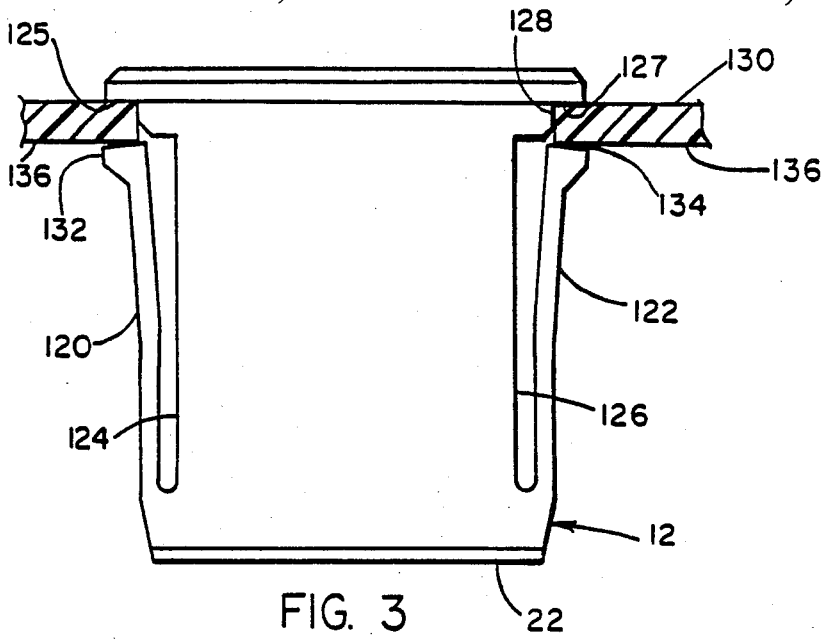
FIG. 3 is a top view of the connector receptacle showing the preferred means of securing the receptacle to the support means.

As shown in FIG. 3, connector receptacle housing 12 may be adapted with outwardly biased extensions 120, 122 extending from sides 124, 126 near end 22, extensions 120, 122 are forcibly compressed towards sides 124, 126 during insertion through aperture 128 in support member 130. Opposing ridges 125, 127 extend from housing 12 beyond the profile of aperture 128 to limit depth of insertion of housing 12 into aperture 128. Ridges 125, 127 may be provided in the form of tabs (not shown) or may preferably extend on all sides to completely cover aperture 128 when connector receptacle 12 is installed in aperture 128. Upon complete insertion of housing 12 into aperture 128, ends 132, 134 of extensions 120, 122 uncompress from sides 124, 126 to contact inside surface 136 of support member 130, thereby resisting removal of housing 12 through aperture 128.

Figure 2:
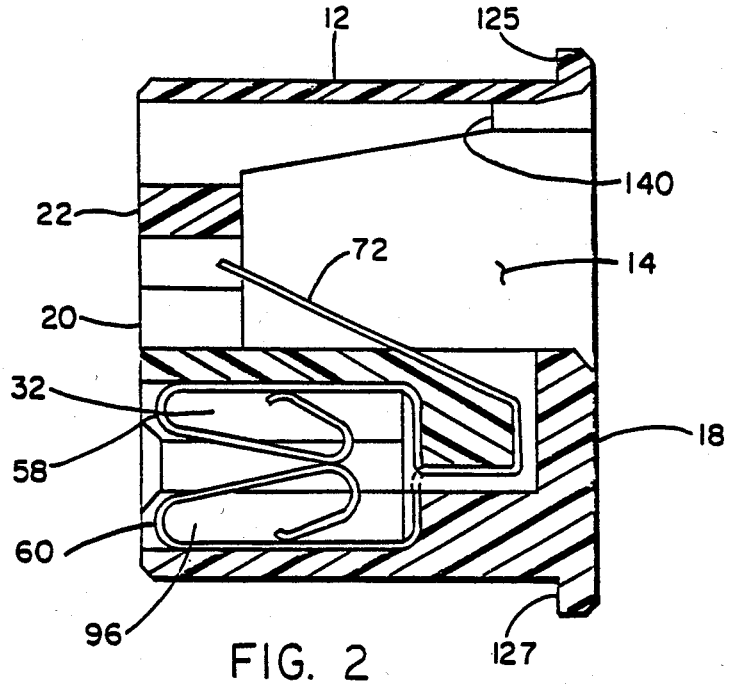
FIG. 2 is a cross-sectional view of the connector receptacle, taken along lines 2—2 in FIG. 1, showing the insert member and electrical contacts positioned within the connector receptacle.

As shown in FIG. 2, a phone jack retaining tab 140 may be molded into connector receptable housing 12 aperture 14 near end 18 to engage tab 142 on phone jack 16 upon full insertion of phone jack 16 into aperture 14. This enables tab 142 to bias into engagement with tab 140 to maintain phone jack 16 within housing aperture 14. This feature is well known in the art. Contacts 82 in phone jack 16 bias against active contact regions 72, 92 of contacts 58, 60 when inserted into housing 12 to provide electrical communication between contactors 58, 60 and contacts 82 in phone jack 16.

The insulated electrical connector receptacle herein disclosed enables snap installation of connector receptacle 10 into aperture 128 in support member 130, without requiring tools or other apparatus to install receptacle in support member 130. Once installed, phone-type jacks 16 or printed circuit boards 24 may be inserted or removed from receptacle 10 independently of each other, without requiring tools or other apparatus.

A plurality of connector receptacles 10 may be positioned within complementary apertures 128 in support member 130, to receive one or more printed circuit boards or phone-type jacks to provide electrical communication between the conductor paths 29 on the printed circuit board 24 and the phone-type jack 16 through contacts 58, 60 installed within connector receptacle housing 12.

Figure 5:
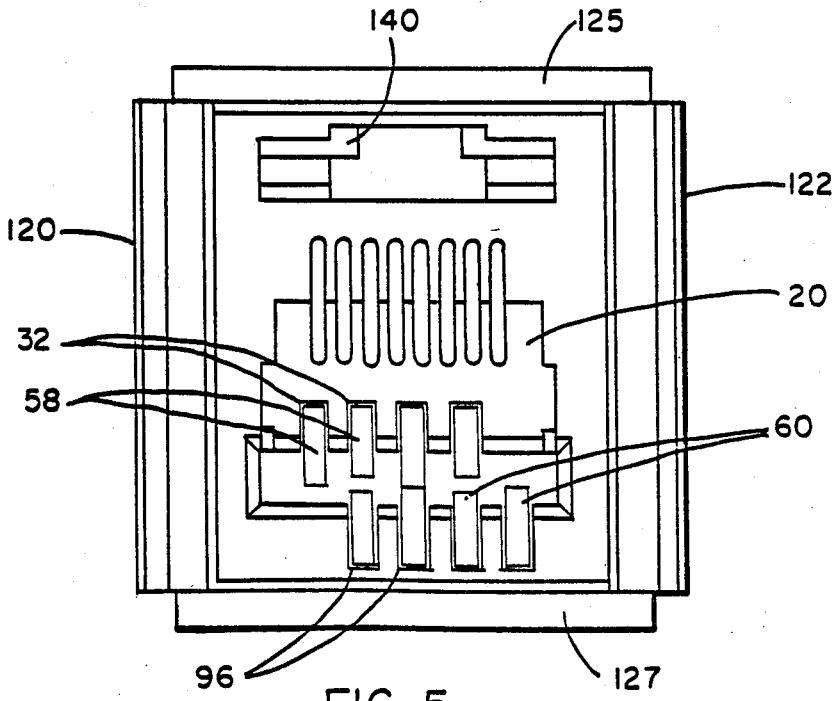
FIG. 5 is an end view of the printed circuit insert side of the connector receptacle, showing the preferred contact positions prior to insertion of the printed circuit board.

Contacts 58, 60 may be formed to avoid contact, or adapted to contact opposing pairs of contacts 58, 60 as shown in FIG. 5, when printed circuit board 24 is removed from lower aperture 14. This selective contact upon removal of the printed circuit board 24 from aperture 14, can be adapted by one skilled in this art to provide a switching or relay function to signal or otherwise communicate the removal of the printed circuit board from the connector receptacle, thereby eliminating the need for an additional switch to provide this function.

One such use would be to provide a busy signal from a computer modem to a caller when a printed circuit board is removed from the connector receptacle.

To assemble the component parts of this invention, contacts 58, 60 are formed and inserted into slots 26, 30 in insert member 20. Insert member 20 is then guided into position within aperture 14 along complementary guide means 40, 42 and 44, 46. Retaining means 52, 54 engage retaining means 48, 50, to secure insert member 20 within aperture 14 upon full insertion.

The connector receptacle assembly 10 may then be inserted through a complementary aperture 128 wherein the connector receptacle 10 is secured without the need for tools or other apparatus as previously disclosed.

Once installed in support member 130, phone-type jack 16 or printed circuit board 24 may be independently inserted or removed from connector receptacle as required, without use of tools.

Where required, more than one connector receptacle assembly 10 may be adapted to align and electrically communicate with selected conductor paths 29 located on a single printed circuit board 24. This design further provides for electrical communication with conductor paths 29 on opposite sides 25, 27 of a printed circuit board.

Therefore, while the invention has been described with reference to a particular embodiment, it is to be understood that modifications may be made without departing from the spirit of the invention or from the scope of the following claims.

INDUSTRIAL APPLICABILITY

This invention is intended for use as an electrical connection receptable device for use between a printed circuit board and a phone-type jack for electrical communication therebetween; for use in electronic apparatus such as phones, modems, computers and the like.

I claim:

1. An electrical connector receptacle apparatus for mounting to a support member, said connector receptacle for releasably receiving a mating standard telephone jack connector and a portion of a printed circuit board having circuitry disposed thereon, which comprises:

(a) an insulated housing having at least one aperture therethrough, said housing aperture having a plurality of wide slots disposed in spaced relation at least partially along the lower portion of the housing aperture;

(b) an insulated insert member having a first plurality of narrow slots disposed in spaced relation on an insert end of the insert member, and a second plurality of complementary wide slots disposed at least partially along a bottom portion of the insert member, said insert member disposed within a portion of the housing aperture;

(c) a first plurality of electrical contact members, each having a wide contact area at one end, a portion of the wide contact area disposed within the second plurality of wide slots in the insulated insert member, each said first plurality of electrical contact members formed with an offset narrow contact area at the opposite end, each narrow contact area having a narrow contact portion formed to extend through one of the first plurality of alternate narrow slots in the insert member;

(d) a second plurality of electrical contact members, each having a wide contact area at one end, a portion of the wide contact area disposed within one of the plurality of wide slots on the bottom of the housing aperature; each of the second plurality of contacts formed with an offset narrow contact area at the opposite end, each narrow contact area having a narrow contact portion formed to extend through alternate narrow slots in the insert member in spaced relation adjacent to one of the plurality of first contact members; and (e) a mounting means for positioning and securing the connector receptacle to the support member, wherein narrow contact portions of the first and second plurality of electrical contact members extend beyond the slots in the insert member to make electrical contact with a plurality of mating contacts on the electrical telephone jack connector, when the telephone jack connector is inserted within a portion of the housing aperature, and a portion of the wide contact area of each of the first and second plurality of electrical contact members is positioned in an opposing relation to make electrical contact with circuitry disposed upon the circuit board, when the circuit board is inserted within a portion of the housing aperture.

2. The connector receptacle apparatus of claim 1, wherein the mating standard telephone jack connector and the portion of the circuit board are slideably received into the housing aperture from opposite ends of said housing.

3. The apparatus of claim 1, wherein the housing mounting means is a raised portion extending about the circumference of the housing, said raised portion of a size larger than the mounting aperture in the supporting member.

4. The apparatus of claim 1, wherein the housing retaining means is a flexibly biased protrusion extending from opposing walls of said housing, positioned to flex inward during insertion of the housing into a closely received aperture in said support member, said extension being sized to flex outward upon full insertion of said housing into said aperture in said support member to secure said housing in said support member.

5. The apparatus of claim 1, wherein opposing guide means extend substantially the length of the insert member, to be closely received and positioned by complementary guide means in said housing aperture, to position said insert member in said housing aperture.

6. The apparatus of claim 1, wherein the housing aperture is extended along a portion of the opposing housing sides in the area of printed circuit board insertion, to allow insertion of a printed circuit board without an insert tab into said connector receptacle.

7. The connector receptacle apparatus of claim 1, wherein the wide contact area of the first and second contact members comprise:

a formed wide contact portion extending near the aperture opening, and bent back to form an inclined wide contact portion extending towards the center of the housing, whereupon the remaining end portion of the wide contact area is bent back to bias against a portion of said wide contact area in a manner to provide positive spring engagement between a portion of the inclined wide contact area and the portion of the circuit board inserted into the aperture in said housing.

8. The connector receptacle apparatus of claim 1, wherein the wide and narrow contact areas of the first and second plurality of contacts are selectively plated with an improved electrical conducting material on the narrow end portion contacting the telephone jack connector and on the wide end portion contacting the circuit board.

9. The connector receptacle apparatus of claim 8, wherein the improved electrical conducting material is selectively plated by gold plating.

10. The connector receptacle apparatus of claim 1, wherein a wide contact portion of at least one of the first and second plurality of contact members are aligned in an opposing relation to contact each other when the printed circuit board is removed from the housing aperture to provide an electrical switching function therebetween.

11. The connector receptacle apparatus of claim 1, wherein a third plurality of narrow slots are disposed in spaced relation on the upper portion of the insert member in complimentary alignment with the first plurality of narrow slots disposed on the end of the insert member to guide the narrow ends of the first and second plurality of electrical contact members in spaced relation therebetween.

12. The connector receptacle apparatus of claim 1, wherein the first plurality of narrow slots in the insert member is eight narrow slots; and a second plurality of wide slots in the insert member is four wide slots; and the plurality of wide slots in the lower portion of the housing aperture is four wide slots.

13. The connector receptacle apparatus of claim 12, wherein three of the four wide slots in the insert member are in a complementary opposing alignment with three of the four wide slots extending partially along the lower portion of the housing aperture.

* * * * *